US007117649B2

(12) United States Patent
Morris et al.

(10) Patent No.: US 7,117,649 B2
(45) **Date of Patent: *Oct. 10, 2006**

(54) VENTED FURRING STRIP

(75) Inventors: Richard J. Morris, Prior Lake, MN (US); Dwight Sheldon, Oregon City, OR (US)

(73) Assignee: Diversi-Plast Products, Inc., Minneapolis, MN (US)

( * ) Notice: Subject to any disclaimer, the term of this patent is extended or adjusted under 35 U.S.C. 154(b) by 52 days.

This patent is subject to a terminal disclaimer.

(21) Appl. No.: 11/052,652

(22) Filed: Feb. 7, 2005

(65) Prior Publication Data

US 2005/0144906 A1 Jul. 7, 2005

Related U.S. Application Data

(63) Continuation of application No. 10/706,606, filed on Nov. 12, 2003.

(60) Provisional application No. 60/426,730, filed on Nov. 15, 2002.

(51) Int. Cl.
*L04H 12/28* (2006.01)

(52) U.S. Cl. ..... 52/302.3; 52/302.1; 52/553; 52/95

(58) Field of Classification Search ..... 52/302.1, 52/302.3, 553, 90.1, 95, 551; 428/138
See application file for complete search history.

(56) References Cited

U.S. PATENT DOCUMENTS

| | | | | | |
|---|---|---|---|---|---|
| 2,804,657 | A | * | 9/1957 | Munters | 52/302.3 |
| 3,041,219 | A | * | 6/1962 | Steck | 428/138 |
| 3,185,070 | A | | 5/1965 | Smith | |
| 3,889,892 | A | | 6/1975 | Melead | |
| 3,949,657 | A | | 4/1976 | Sells | |
| D257,282 | S | | 10/1980 | Roberts | |
| D257,283 | S | | 10/1980 | Roberts | |
| 4,663,207 | A | * | 5/1987 | Kupersmit | 428/119 |
| 4,803,813 | A | | 2/1989 | Fiterman | |
| 4,807,409 | A | | 2/1989 | Sells | |
| 4,843,953 | A | * | 7/1989 | Sells | 454/365 |
| 4,942,699 | A | | 7/1990 | Spinelli | |
| 5,005,330 | A | | 4/1991 | Todisco | |
| 5,054,254 | A | | 10/1991 | Sells | |
| 5,092,225 | A | | 3/1992 | Sells | |
| 5,094,041 | A | | 3/1992 | Kasner et al. | |
| 5,099,627 | A | | 3/1992 | Coulton et al. | |
| 5,242,736 | A | | 9/1993 | Van Erden et al. | |
| 5,304,095 | A | | 4/1994 | Morris | |
| 5,319,908 | A | | 6/1994 | Van Erden et al. | |
| 5,328,407 | A | | 7/1994 | Sells | |
| 5,331,783 | A | | 7/1994 | Kasner et al. | |
| 5,349,804 | A | | 9/1994 | Van Erden et al. | |

(Continued)

*Primary Examiner*—Carl D. Friedman
*Assistant Examiner*—Basil Katcheves
(74) *Attorney, Agent, or Firm*—Patterson, Thuente, Skaar & Christensen, P.A.

(57) ABSTRACT

A wall system for a structure including elongate furring strips having a multiplicity of transversely oriented air passages. The elongate furring strips are arranged on a first envelope layer of a wall and covered with a second envelope layer. The furring strips space the first and second envelope layers apart, forming a plurality of enclosed cavities or air spaces. The cavities are in fluid communication with each other through the air passages in the furring strips, and may be in fluid communication with the outside atmosphere. Air is thusly enabled to circulate from the outdoors through substantially all portions of the cavities, promoting drying of the first and second envelope layers, which may be sheathing and finish siding.

32 Claims, 5 Drawing Sheets

U.S. PATENT DOCUMENTS 5,419,867 A 5/1995 Van Erden et al.
5,427,571 A 6/1995 Sells
5,603,657 A 2/1997 Sells
5,651,734 A 7/1997 Morris
5,673,521 A 10/1997 Coulton et al.
5,711,116 A 1/1998 Hasan
5,816,014 A 10/1998 Tzeng et al.
5,947,817 A 9/1999 Morris et al.
6,039,646 A * 3/2000 Sells ..... 454/365
6,357,193 B1 3/2002 Morris
6,598,356 B1 * 7/2003 Sells ..... 52/90.1

* cited by examiner

VENTED FURRING STRIP

RELATED APPLICATIONS

This is a request for filing a Continuation application, under 37 C.F.R. § 1.53(b), of pending prior application Ser. No. 10/706,606, filed Nov. 12, 2003 for: VENTED FURRING STRIP by: Richard J. Morris, Dwight Sheldon, which in turn claims priority from Provisional Application No. 60/426,730, filed Nov. 15, 2002 for: VENTED by: Richard J. Morris, Dwight Sheldon.

FIELD OF THE INVENTION

The invention relates to wall systems of structures, and more specifically to devices and methods for ventilating wall systems of structures.

BACKGROUND OF THE INVENTION

The exterior walls of modern buildings, especially residential type structures, often include a frame, covered on the exterior side with a sheathing material. Wood sheet products, such as CDX plywood or oriented strand board (OSB), are often used as the sheathing material. Finish siding material is applied over the sheathing for weather and physical damage protection and to give the structure a more attractive appearance.

The finish siding used in construction is usually not completely resistant to water and water vapor infiltration. Water from precipitation may migrate or leak through finish siding. Moreover, moisture-laden air may permeate the finish siding layer during periods of warmer outdoor temperature. When the outdoor temperature drops, the moisture may condense from the air as liquid water onto the surfaces of the finish siding and sheathing, even forming ice at lower temperatures. This condensation may penetrate and saturate porous finish siding material or sheathing material.

Water in any form remaining for extended periods within, or on surfaces of, the finish siding or sheathing materials may have deleterious effects for a structure and its inhabitants. Porous materials may undergo temporary or permanent dimensional changes from water infiltration, including warping and swelling, and subsequent shrinking as the material dries. These dimensional changes can loosen connections between building components, and open seams or cracks, leading to more water infiltration. Organic materials, such as sheathing made from wood products, may rot or become a location for mold and mildew growth. Rotting or other such deterioration may compromise the structural integrity of the building. In addition, mold or mold spores may penetrate into the interior of the structure, causing adverse health consequents for occupants.

One or more layers of building paper are typically applied over sheathing material to retard water infiltration. Usually, this building paper is asphalt impregnated felt material or spun-bonded polyolefin sheeting. Asphalt felt material may become saturated with water if exposed to moisture over a long period, however, in turn causing moisture in the sheathing. The polyolefin materials, on the other hand, are designed to pass moisture vapor, while preventing the passage of bulk water. Without the circulation of dryer air, however, any condensed water present between the polyolefin material and the sheathing may not dry out and the sheathing is consequently exposed to moisture over a long period.

An air space is sometimes created between the finish siding and the building paper covered sheathing material in order to provide a space for air circulation. Typically, an air space is created by first affixing furring strips made from solid material to the sheathing and then affixing the siding to the furring strips. One or more openings to the exterior are provided leading to the space to permit air circulation. Drier air from the exterior circulating within this space may evaporate and absorb any bulk moisture present on the surfaces of the building paper, sheathing, or finish siding.

It is, however, necessary that ventilation air freely circulate into this air space in order that a continuous supply of dry air is available to replace the moisture-laden air resulting from the evaporation process. Due to the very confined nature of this air space, and the need to provide a continuous finish siding layer to minimize water leakage to the extent possible, adequate ventilation of this space has proven to be difficult to achieve. For instance, the solid furring strips themselves may block or restrict air circulation.

What is needed is an apparatus, system, and method for effectively ventilating a space provided in the wall system of a structure that overcomes the aforementioned problems.

SUMMARY OF THE INVENTION

The present invention is an apparatus, system, and method for ventilating a space provided in the wall system of a structure that overcomes the aforementioned problems. The invention includes a wall system for a structure including elongate furring strips having a multiplicity of transversely oriented air passages. The elongate furring strips are arranged on a first envelope layer of a wall and covered with a second envelope layer. The furring strips space the first and second envelope layers apart, forming a plurality of enclosed cavities or air spaces. The cavities are in fluid communication with each other through the air passages in the furring strips, and may be in fluid communication with the outside atmosphere. Air is thusly enabled to circulate from the outdoors through substantially all portions of the cavities, promoting drying of the first and second envelope layers, which may be sheathing and finish siding. In addition, furring strips according to the invention may be positioned at the bottom edge of the wall assembly so that any liquid bulk water penetrating the siding is enabled to drain out.

DETAILED DESCRIPTION OF THE PREFERRED EMBODIMENTS

Figure 1:
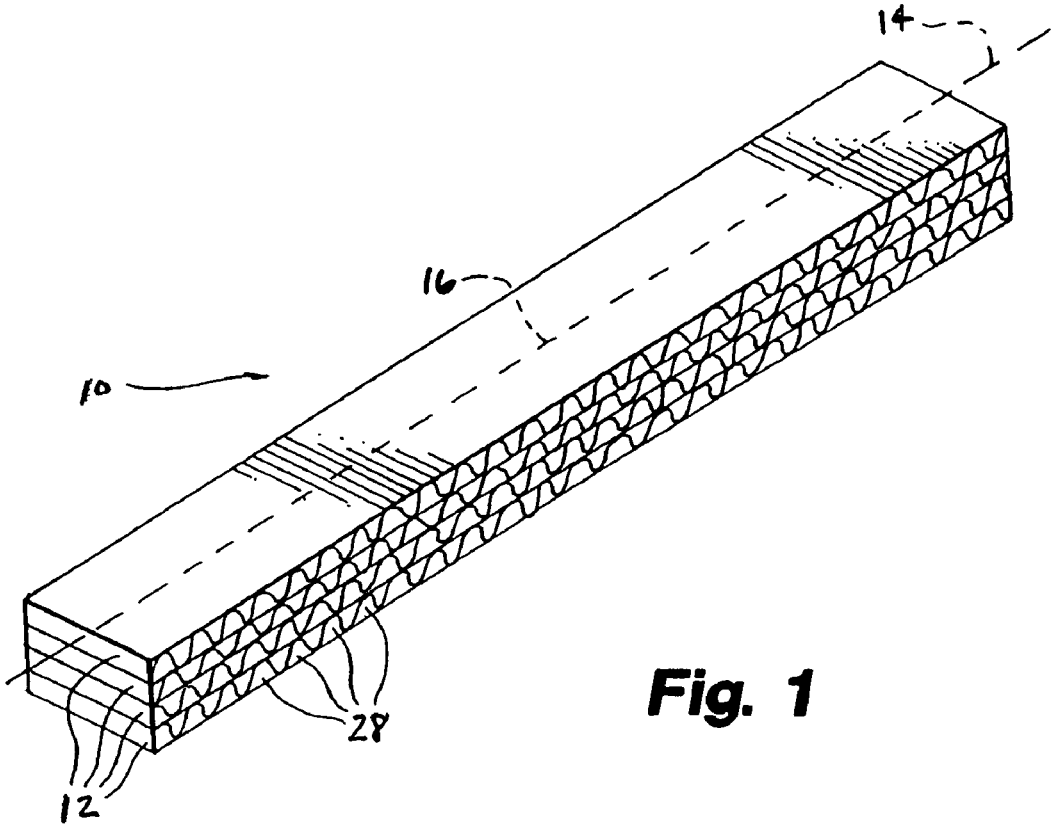
FIG. 1 is a perspective view of one embodiment of the furring strip of the invention.
Figure 2:
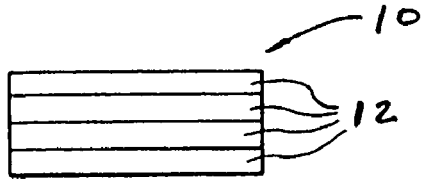
FIG. 2 is an end view of the furring strip of FIG. 1.

An exemplary furring strip 10 is depicted in FIGS. 1 and 2. Furring strip 10 generally includes one or more layers 12 and may present a longitudinal axis 14. Layers 12 are described below and generally serve two functions. The first function is to allow water to drain therethrough. The second is to enable air exchange. These complimentary functions promote drainage, prevent water condensation, and promote drying of the interstitial space between components of exterior walls of a structure in which the furring strip 10 is used. While one or more layers 12 are contemplated to be within the scope of this invention, if a plurality of layers 12 are present, these layers may be stacked and fixed to each other by such means as stitching 16. However, other fastening means which may be used include hot air welding (or other fastening means using thermal energy), ultrasonic welding, infrared bonding, staples, glue, or other methods known to the art. The structure of furring strip 10 may be generally similar to the roof batten disclosed in U.S. Pat. No. 6,357,193, a copy of which is hereby fully incorporated herein by reference.

Figure 3:
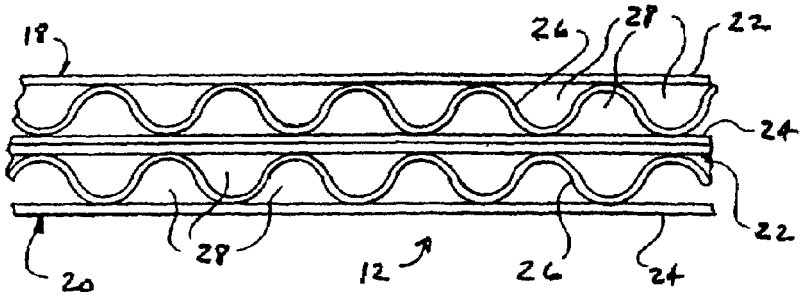
FIG. 3 is a fragmentary, cross-sectional view of a first embodiment of two portions of the furring strip of FIG. 1.

One embodiment of layer 12 is depicted in FIG. 3. Layer 12 has two portions 18, 20. Each portion 18, 20 includes planar plies 22 and 24 and convoluted ply 26. Convoluted ply 26 is disposed between and bonded to (or otherwise cooperates with) planar plies 22 and 24 to define a multiplicity of air channels 28 therebetween. Channels 28 extend generally perpendicularly, or otherwise generally transversely, to longitudinal axis 14 of furring strip 10.

Figure 4:
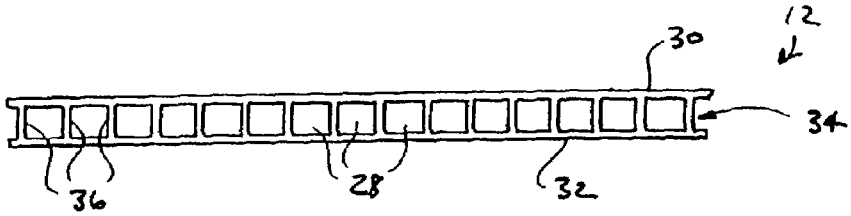
FIG. 4 is a fragmentary, cross-sectional view of a second embodiment of one layer of the furring strip of FIG. 1.

Another embodiment of layer 12 is depicted in FIG. 4. Layer 12 includes planar plies 30 and 32 and second ply 34. Second ply 34 includes a multiplicity of cross-plies 36. Cross-plies 36 extend generally perpendicular (or otherwise transversely) between planar plies 30 and 32. Thus, planar plies 30 and 32 and second ply 34 cooperate to define a multiplicity of air channels 28 therebetween.

Figure 5:
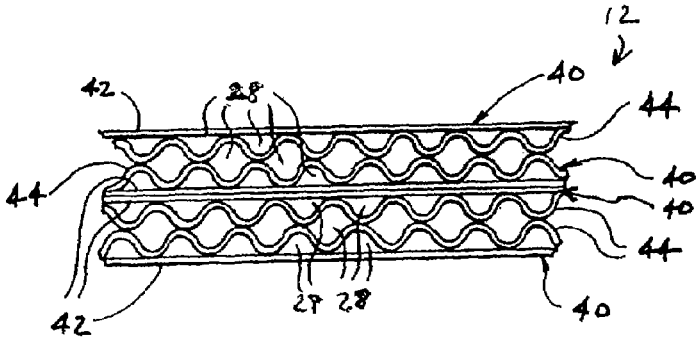
FIG. 5 is a fragmentary, cross-sectional view of a third embodiment of four portions of the furring strip of FIG. 1.

Referring to FIG. 5, yet another embodiment of layer 12 is depicted generally. Layer 12 has four portions 40, each generally including planar ply 42 and convoluted ply 44. Planar and convoluted plies 42 and 44 are bonded to (or otherwise cooperate with) each other to define a multiplicity of air channels 28 therebetween. Portions 40 may be stacked such that convoluted plies 44 abut, thereby defining another multiplicity of air channels 28 therebetween.

These embodiments of layer 12 include a corrugated plastic (resin) material with a nominal weight appropriate for the structure, and often between a range of about 140 and 160 pounds per thousand square feet. One nominal weight may be about 150 pounds per thousand square feet. The plastic resin may have a 4.0 to 4.5-millimeter profile. The plastic resin may further include an about 4.0 (.+–.0.2) millimeter profile. The plastic material may still further be black and include ultraviolet (UV) inhibitors to enable the plastic resin to withstand extended exposure to direct UV light. The plastic resin may include a high-density, polyethylene, corrugated, plastic resin with a brittleness temperature of about −103.0 degrees F., a deflection temperature of about +162.0 degrees F. at 66 pounds per square inch, a burn rate of about 2.5 inches per minute, a self-ignition temperature of about 734.0 degrees F., and may also merit a label of "excellence" for smoke density of a 9.3 percent average.

Figure 6:
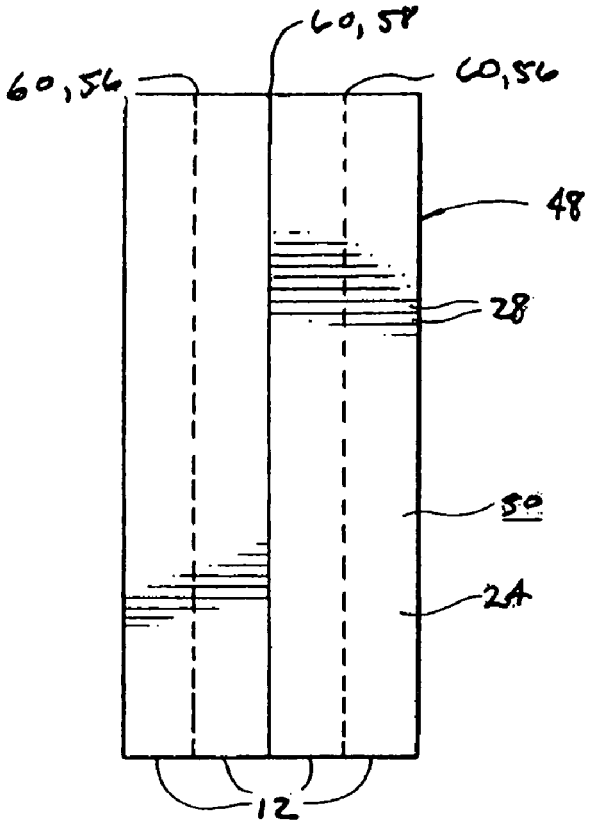
FIG. 6 is a plan view of a sheet of convoluted material suitable for forming the furring strip of FIG. 1.
Figure 7:
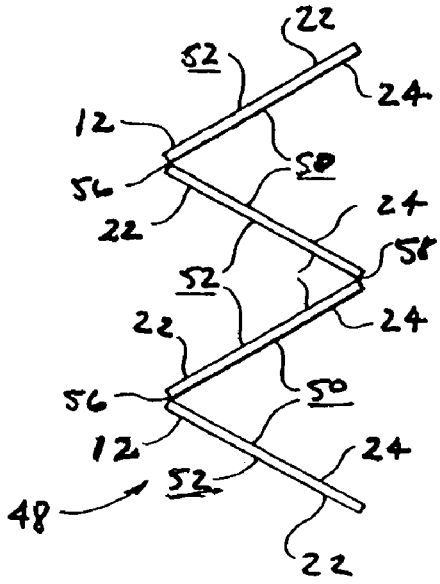
FIG. 7 is a side plan view of the sheet of FIG. 6 being foldably assembled into the furring strip of FIG. 1 after layers have been defined therein.

Referring to FIGS. 6 and 7, exemplary sheet 48 may be formed of the materials discussed with respect to FIG. 3 and further described above. Thus, sheet 48 includes a multiplicity of channels 28 defined by a cooperation of members such as planar plies 22 and 24 and convoluted ply 26. Sheet 48 displays first and second surfaces 50 and 52. Exemplary layers 12 may be formed from sheet 48 by the slit-scoring technique or by the nick-scoring technique, each technique being more fully described below. Alternatively, layers 12 may be formed by completely severing sheet 48 generally along lines 54. Separate layers 12 are then stacked and fixed as described above.

The slit-scoring technique is described in U.S. Pat. No. 4,803,813, the entire contents of which are hereby incorporated by reference. In the slit-scoring technique, hingelines 56 alternate with hingelines 58. Hingelines 56 are defined by extending a slit generally along a line 60 and parallel (or generally transversely) to channels 28. The slit extends through planar ply 22 and convoluted ply 26, thereby leaving planar ply 24 intact. Hingelines 58 are defined by extending a slit generally along a line 60 and generally parallel to hingelines 56. The slit extends through planar ply 24 and convoluted ply 26, thereby leaving planar ply 22 intact. Intact planar plies 22 and 24 are thus used as hinges and furring strip 10 is assembled by Z-folding layers 12 along hingelines 56 and 58 in the manner depicted in FIG. 7.

The nick-scoring technique is an alternative hinge-forming technique described in U.S. Pat. No. 5,094,041, the entire contents of which are hereby incorporated by reference. In the nick-scoring technique, lines 60 include a series of generally linear perforations. Each perforation substantially extends through planar plies 22 and 24 and convoluted ply 26. Substantially intact portions of planar plies 22 and 24 and convoluted ply 26 remain between perforations. Lines 60 are thusly formed into hinges and thereby define layers 12. Layers 12 may be Z-folded along lines 60 in a manner substantially resembling FIG. 7 to assemble furring strip 10. Still another hinge-forming technique includes forming completely separated layers 12 and hingably connecting adjacent layers 12 with a pliable adhesive member such as tape.

Figure 8:
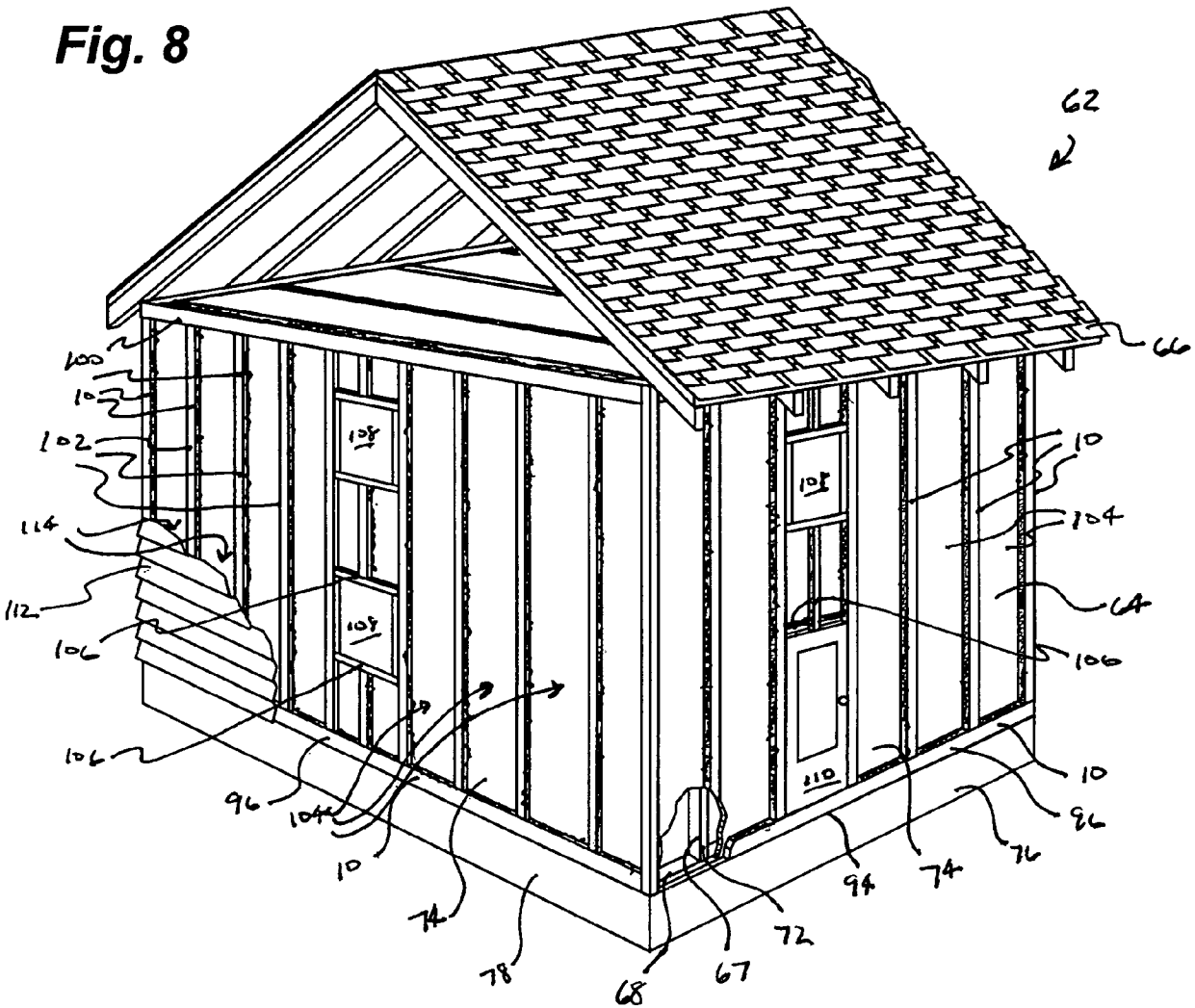
FIG. 8 is a perspective, partial cut away view of a structure showing an application of the present invention.
Figure 9:
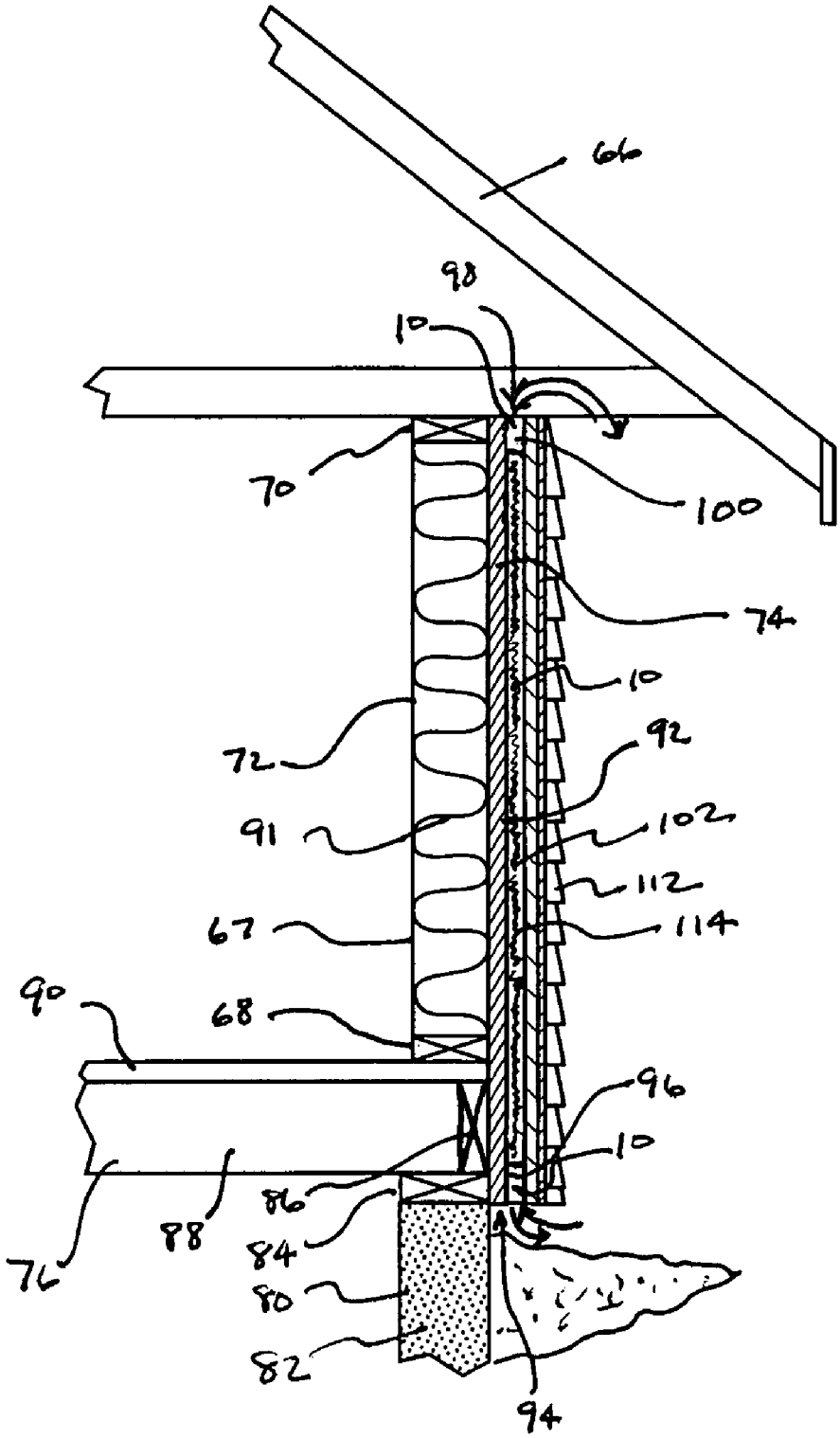
FIG. 9 is a cross-sectional view of a wall system according to the present invention.

Depicted in FIGS. 8 and 9 are embodiments of wall systems for a structure 62 according to the present invention. Structure 62 generally includes exterior frame wall assembly 64 and roof structure 66. Wall assembly 64 generally includes a structural frame 67 which includes sole plate 68, top plate 70, and a plurality of studs 72, with sheathing 74 on the outside of structural frame 67. Sole plate 68 rests on floor assembly 76, which may be a concrete slab 78 directly on-grade as depicted in FIG. 8, or a foundation system 80 as depicted in FIG. 9. Foundation system 80 as depicted in FIG. 9 is conventional and generally includes a foundation wall 82, sill plate 84, band joist 86, a plurality of spaced-apart joists 88, and a floor membrane 90.

Studs 72 extend vertically upward connecting sole plate 68 to top plate 70. Insulation 91 may be installed between studs 72. In a frame structure as depicted, studs 72 are typically the vertical structural load bearing elements of the wall assembly 64 and may also serve as support for sheathing 74, which in turn may serve as a portion of the outer envelope of structure 62. As previously mentioned, one or more layers of building paper 92 may cover the exterior surface of sheathing 74 to provide moisture protection and to retard air infiltration into the interior of structure 62.

In the invention, one or more furring strips 10 may be arranged in a row on sheathing 74 at the bottom edge 94 of wall assembly 64 to form a bottom vent 96. Similarly, one or more furring strips 10 may be arranged in a row at the top edge 98 of wall assembly 64 to form a top vent 100 as depicted. Additional furring strips 10 may then be arranged to form vertical vents 102 on the sheathing 74 at spaced apart intervals so as to define a plurality of recesses 104 therebetween. Additional vents 106 may be arranged around windows 108 or door 110. Alternatively, solid furring strips may be arranged in these locations.

Finish siding 112 may be then be fastened covering furring strips 10 and sheathing 74 to form the outer surface of structure 62. Furring strips 10 space finish siding 112 apart from sheathing 74, with recesses 104 forming enclosed cavities 114. Air from the exterior is admitted to cavities 114 through bottom vent 96, top vent 100, and optionally through additional vents 106 provided around windows 108 and door 110, and may pass through vertical vents 102 so as to freely circulate between adjacent cavities 114 thereby promoting drying of any moisture present in cavities 114.

Thus, air admitted from the outdoors through bottom vent 96 or top vent 100 is enabled to flow through the cavities 114 formed between the siding 112 and the sheathing 74 over substantially all portions of wall assembly 64, promoting drying of wall assembly 64. In addition, any liquid water present in cavities 114 is enabled to drain out through channels 28 in bottom vent 96.

Furring strips 10 may be fastened to sheathing 74 using any suitable fastening means, including nails, screws, adhesives, or tape. A covered adhesive strip, such as is disclosed in U.S. Pat. No. 6,267,668, a copy of which is hereby fully incorporated herein by reference, may be provided on a surface of furring strip 10 to facilitate installation. Generally, it is desirable to affix furring strips 10 over the wall framing members, such as studs 72, and any headers and plates, since siding is normally fastened to these members. Placement of furring strips 10 over framing members and with the siding fasteners extending therethrough promotes stability of wall assembly 64 and may inhibit undesirable slippage and sagging of the siding 112.

It will be appreciated that the furring strips 10 of the present invention may be arranged in any desired pattern on the surface of sheathing 74, as needed to promote ventilation and drainage. For example, furring strips 10 may be arranged primarily vertically, primarily horizontally, or in any other desired orientation.

Exemplary furring strip 10 may be about ⅝ inches in thickness and about 1½ inches in width, or may be any other thickness or width dimension as may be desirable. Furring strip 10 may be made in a variety of standard lengths, such as 92⅝" or 96 inches, to accommodate standard wall height dimensions, or may be made in other length dimensions and cut to length as needed. In addition, each furring strip 10 may be scored so as to be foldable in segments for easy handling and storage. Exemplary furring strip 10 may be used with any type of siding including wood siding, vinyl, and metal. Also, furring strips 10 may be used to provide ventilation to airspaces behind masonry structures such as brick veneer, and with suitable backing structure, spray or trowel applied finishes such as stucco.

Although exemplary furring strips 10 have been depicted herein as used in conjunction with frame type wall assemblies, it is contemplated that the present invention could be used with any type of wall construction wherein it is desirable to provide a ventilated interstitial space between wall components. In this aspect, the furring strips 10 of the present invention may be used, for example, with a curtain wall type of construction.

Exemplary furring strip 10 of this invention thereby promotes ventilation and inhibits water accumulation within wall assemblies. The result of installing the furring strip 10 of this invention is thusly a wall, which remains drier and is more protected from decomposition and damage than if furring strips or other devices in the prior art were used. The furring strip of this invention will not rot, warp, or absorb water as do many of the wooden furring strips of the prior art. Furring strip 10 of this invention may also enable a substantial decrease in time and expense necessary to install siding as compared to solid furring strip systems in the prior art. In contrast to wood furring strips for example, furring strips 10 are easily cut to desired lengths with utility knives.

What is claimed is:

1. A wall system for a structure, the system comprising:

a structural frame presenting an exterior side and an interior side; and first and second envelope layers on the exterior side of the structural frame, the first and second envelope layers being substantially coextensive and spaced apart by a plurality of furring strips, each furring strip of the plurality of furring strips including at least one layer comprising a generally planar first ply and a second ply, the first and second plies cooperating to define a multiplicity of passages extending generally transversely to a longitudinal axis of the furring strip, the plurality of furring strips arranged so as to define a plurality of enclosed cavities between the first and second envelope layers, each cavity being fluidly coupled to at least one adjacent cavity through the passages in one of the plurality of furring strips.

2. The wall system of claim 1, wherein at least one of the first and second envelope layers comprises sheathing.

3. The wall system of claim 1, wherein at least one of the first and second envelope layers comprises finish siding.

4. The wall system of claim 1, wherein the second ply of each furring strip of the plurality of furring strips is generally convoluted.

5. The wall system of claim 4, wherein each furring strip of the plurality of furring strips has at least a pair of first plies.

6. The wall system of claim 5, wherein the second ply of each furring strip of the plurality of furring strips includes a multiplicity of cross-plies extending between the first plies.

7. The wall system of claim 4, wherein each furring strip of the plurality of furring strips has a plurality of layers.

8. The wall system of claim 7, wherein adjacent layers of the plurality of layers are hingably connected at a hingeline extending generally parallel to the longitudinal axis of the furring strip.

9. The wall system of claim 8, wherein the hingeline of the furring strip is defined by a slice extending through the second ply and one of the first plies of the furring strip.

10. The wall system of claim 8, wherein the furring strip has first and second hingelines, the first hingeline defined by a first slice extending through one of the first plies and the second ply, and the second hingeline defined by a second slice extending though the other of the first plies and the second ply.

11. The wall system of claim 8, wherein the hingeline of the furring strip is defined by alternate severed and intact portions, the severed portions comprising substantially severed first and second plies, the intact portions comprising substantially intact first and second plies.

12. The wall system of claim 7, wherein the layers of the furring strip are stacked and fastened together.

13. The wall system of claim 12, wherein the furring strip further comprises means for fastening the layers together.

14. The wall system of claim 12, wherein the layers of the furring strip are fastened together by stitching.

15. The wall system of claim 12, wherein the layers of the furring strip are fastened together by fasteners selected from the group consisting of staples, glue, hot air welding, stitching, ultrasonic welding, infrared bonding, and any combination thereof.

16. A method of constructing a ventilated wall system for a structure, the method comprising the steps of:

operably disposing a first envelope layer on a structural frame defining the structure;

forming a plurality of elongate furring strips, each furring strip having a pair of opposing sides and comprising at least one layer of a material having first and second plies defining a multiplicity of air passages therethrough, the air passages extending generally transversely to the sides of the furring strip;

affixing the plurality of furring strips on the first envelope layer so that the furring strips and the first envelope layer define a plurality of recesses; and enclosing the recesses with a second envelope layer substantially coextensive with the first envelope layer and disposed over the plurality of furring strips, each enclosed recess being fluidly coupled to at least one adjacent recess through the air passages of at least one of the plurality of furring strips.

17. A wall system for a structure, the system comprising:

a structural frame presenting an exterior side and an interior side; and first and second envelope layers on the exterior side of the structural frame, the first and second envelope layers being substantially coextensive and spaced apart by a plurality of elongate furring strips, each furring strip having a pair of opposing sides, the furring strips spaced apart so as to define a plurality of separate cavities between the first and second envelope layers, each furring strip having means for fluidly coupling cavities adjacent each of the opposing sides of the furring strip.

18. The wall system of claim 17, wherein the means for fluidly coupling cavities adjacent each of the opposing sides of the furring strip comprises a multiplicity of air passages extending between the opposing sides of the furring strip.

19. The wall system of claim 18, wherein the air passages extend generally transversely to a longitudinal axis of the furring strip.

20. The wall system of claim 18, wherein each furring strip includes at least one layer comprising a generally planar first ply and a second ply, the first and second plies cooperating to define the multiplicity of air passages.

21. The wall system of claim 20, wherein the second ply is generally convoluted.

22. The wall system of claim 21, wherein the furring strip has at least a pair of first plies.

23. The wall system of claim 22, wherein the second ply includes a multiplicity of cross-plies extending between the first plies.

24. The wall system of claim 23, wherein adjacent layers of the plurality of layers are hingably connected at a hingeline extending generally parallel to the longitudinal axis of the furring strip.

25. The wall system of claim 24, wherein the hingeline of the furring strip is defined by a slice extending through the second ply and one of the first plies of the furring strip.

26. The wall system of claim 24, wherein the furring strip has first and second hingelines, the first hingeline defined by a first slice extending through one of the first plies and the second ply, and the second hingeline defined by a second slice extending though the other of the first plies and the second ply.

27. The wall system of claim 24, wherein the hingeline of the furring strip is defined by alternate severed and intact portions, the severed portions comprising substantially severed first and second plies, the intact portions comprising substantially intact first and second plies.

28. The wall system of claim 21, wherein the furring strip has a plurality of layers.

29. The wall system of claim 28, wherein the layers of the furring strip are stacked and fastened together.

30. The wall system of claim 29, wherein the furring strip further comprises means for fastening the layers together.

31. The wall system of claim 29, wherein the layers of the furring strip are fastened together by stitching.

32. The wall system of claim 29, wherein the layers of the furring strip are fastened together by fasteners selected from the group consisting of staples, glue, hot air welding, stitching, ultrasonic welding, infrared bonding, and any combination thereof.

* * * * *

UNITED STATES PATENT AND TRADEMARK OFFICE

CERTIFICATE OF CORRECTION

PATENT NO. : 7,117,649 B2
APPLICATION NO. : 11/052652
DATED : October 10, 2006
INVENTOR(S) : Richard J. Morris et al.

It is certified that error appears in the above-identified patent and that said Letters Patent is hereby corrected as shown below:

Column 5, Line 6:

After "may" delete "be".

Signed and Sealed this

Tenth Day of July, 2007

JON W. DUDAS
*Director of the United States Patent and Trademark Office*